United States Patent [19]

Conway

[11] 3,943,977

[45] Mar. 16, 1976

[54] PICKER STICK CHECK

[75] Inventor: William N. Conway, North Grafton, Mass.

[73] Assignee: Rockwell International Corporation, Pittsburgh, Pa.

[22] Filed: Feb. 3, 1975

[21] Appl. No.: 546,316

[52] U.S. Cl. ..... 139/166
[51] Int. Cl.[2] ..... D03D 49/40
[58] Field of Search ..... 139/166–170, 139/165, 161 R, 161 S

[56] References Cited

UNITED STATES PATENTS

| | | | |
|---|---|---|---|
| 2,262,255 | 11/1941 | Sargent | 139/166 X |
| 3,020,933 | 2/1962 | Nagenburg, Jr. et al. | 139/166 |
| 3,441,062 | 4/1969 | Messer | 139/166 |
| 3,818,953 | 6/1974 | Flukiger | 139/166 |

FOREIGN PATENTS OR APPLICATIONS

| | | | |
|---|---|---|---|
| 335,001 | 2/1959 | Switzerland | 139/166 |
| 69,247 | 5/1958 | France | 139/166 |
| 1,254,181 | 1/1961 | France | 139/166 |

*Primary Examiner*—James Kee Chi

[57] ABSTRACT

A loomside mounted picker stick bumper assembly for looms of the fly shuttle type having a fixed resilient bumper member with a floating or slidably movable picker stick braking element operatively associated therewith for stopping the picker stick at the end of its picking stroke. The bumper assembly includes guide members in frictional contact with the braking element for controlling the direction of its sliding movement when engaged by the picker stick and during its return to its initial position by the resilient bumper.

4 Claims, 4 Drawing Figures

PICKER STICK CHECK

BACKGROUND OF THE INVENTION

In fly shuttle looms which utilize picker sticks to propel weft carrying shuttles back and forth through the shed usually have picker stick bumpers or checks of the fixed position type mounted on the loomsides or assembled on the loom in such a location so as to arrest further inward movement of a picker stick after performance of its intended function. These picker stick bumpers or checks are usually made from leather, rubber or the combination of both or of some other resilient material which will satisfactorily serve the same purpose.

Examples of picker stick bumpers or checks that employ bumpers of the type which yield to the directional forces of the picker sticks are disclosed in the teachings of U.S. Pat. Nos. 1,529,896; 1,741,047 and 3,052,267. These bumpers are pivoted and offer resistance to and arrest the picker stick by means of coil and torsional type springs as well as rubber torsional bushings such as disclosed in the above U.S. Pat. No. 3,052,267.

As is well known to those conversant in the weaving art, the loom's lay beam during loom operation is subjected to continuance pivotal movement by the loom's rocker shaft between so-called front and back center positions. The loom's picker sticks also carried by the rocker shaft and being caused to move in a plane substantially normal to the path of movement of the lay beam are caused to pivot concurrently with the latter. The combination of a picker stick moving to propel a shuttle through a warp shed and its pivotal movement with the lay beam causes said picker stick at the end of its picking strode to strike the picker stick bumper, that is attached to the loomside, with a wiping or rubbing blow.

With picker stick bumpers of both the fixed and yielding type this wiping or rubbing blow on the bumper surface by the picker stick at the end of its picking stroke initiates what is considered premature wear to the bumper material as well as said picker stick.

With bumpers which are fixed to the loomside, and not yieldable additional problems exist such as greater shock loading on the picker stick and parallel assembly during loom operation as well as high bumper loads being transmitted to the loomsides in the area where the bumpers are attached thereto.

The picker stick check according to the present invention has corrected the problems described above by providing a loomside mounted picker stick bumper of the floating type. This bumper includes an inner fixedly disposed bumper element and an outer bumper element operatively associated with said inner bumper element. Both bumpers have a common support means and the outer bumper element is assembled thereto in a manner to provide freedom of movement thereof when struck by the picker stick at the end of its picking stroke. The outer bumper element is capable of moving inwardly toward the loomside when struck by the picker stick and at the same time to yield in a rearwardly direction thereby preventing the wiping or rubbing movement of the picker stick on the outer surface of said outer bumper element.

SUMMARY OF THE INVENTION

The picker stick check comprising the invention is in the form of a picker stick bumper assembly carried on a support bracket that is fixed to the framework of a loom or to each of its so-called loomsides. The bumper assembly inclues an inner bumper element fixed to the support bracket and an outer bumper element in strap form operatively associated with said inner bumper element, and assembled to the bracket in a manner to provide freedom of movement thereof when engaged by the picker stick. The support bracket includes a pair of spaced friction lugs which serve to position the outer bumper element and guide its movement when engaged by the picker stick.

The inner bumper element serves as a cushioning member and is effective in returning the outer bumper element to its initial position after completion of the picking cycle.

The outer bumper element is assembled on the support bracket in a manner which permits it to move toward the loomside when contacted by the picker stick and at the same time to yield rearwardly with the picker stick at the end of its stroke which is then moving with the lay beam toward the latters back center position.

It is a general object of the invention to increase the life expectancy of picker sticks and picker stick bumpers by providing bumpers of the type which feature improved operational characteristics over the well known fixed and yielding type bumpers.

It is a more specific object of the invention to provide yielding type bumpers for picker sticks which in addition to yielding in the direction of the loomside when engaged by the picker stick, they will also yield with the picker stick as the latter pivots rearwardly with the lay toward said lay's back center position.

These and other objects of the present invention will become more fully apparent by reference to the appended claims and as the following detailed description proceeds in reference to the figures of drawing wherein:

DESCRIPTION OF THE PREFERRED EMBODIMENT

Figure 4:
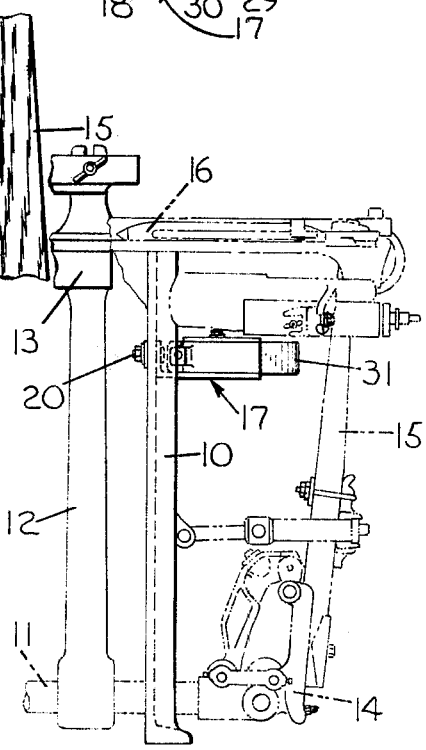
FIG. 4 is a view in front elevation showing a portion of a fly shuttle loom with the picker stick bumper according to the invention assembled thereto.

Now referring to FIG. 4, part of a fly-shuttle loom is shown including a loomside 10, rock shaft 11 to which is clamped a sword 12 at the upper end of which is mounted in the usual way a lay beam 13.

The rock shaft 11 also has a well known type of parallel motion device 14 fixed thereon which carries a picker stick 15 that serves to propel a shuttle 16 across the width of the loom in a manner familiar to those conversant in the weaving art.

The picker stick bumper assembly comprising the invention is indicated generally by numeral 17 and includes an L-shaped support bracket having a horizontally disposed supporting surface 18. An integral flange 19 extends upwardly from one end of surface 18 and provides a means for attaching the bracket to the loomside by suitable retaining members such as bolts 20 (one only shown).

Figure 1:
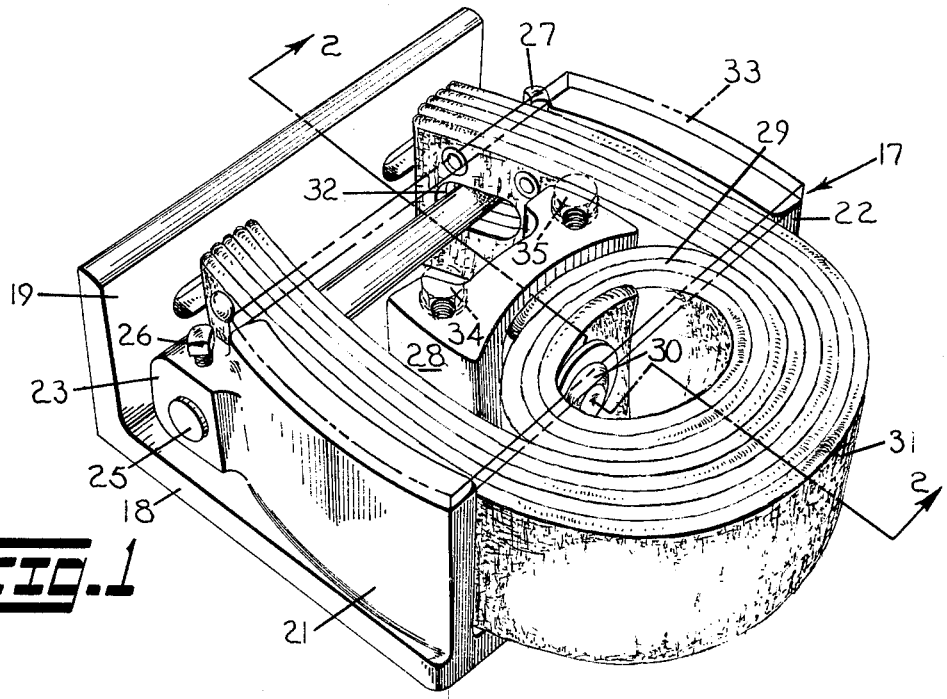
FIG. 1 is a perspective view of the picker stick bumper according to the invention showing the means by which it is assembled to the support bracket therefore.
Figure 2:
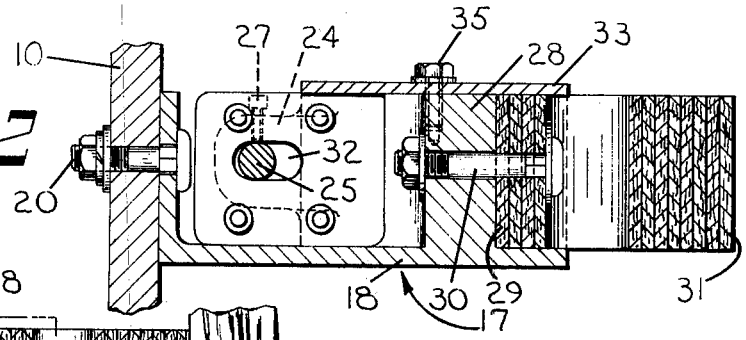
FIG. 2 is a sectional view taken along line 2—2 in FIG. 1 showing the position of the outer bumper element prior to being engaged by the picker stick.
Figure 3:
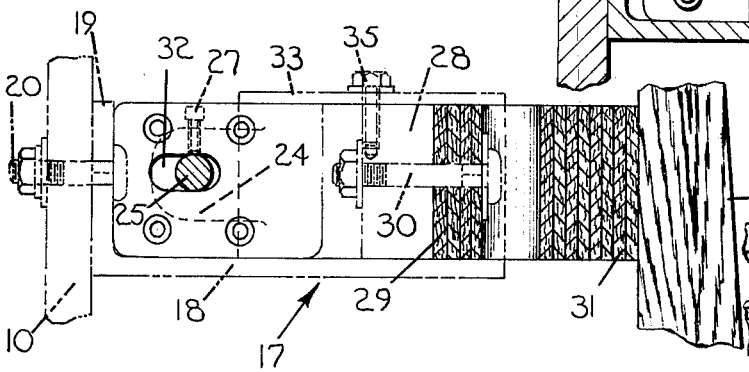
FIG. 3 is a view similar to that of FIG. 2 showing the outer bumper element being contacted by the picker stick.

The supporting surface 18 as shown in FIG. 1 is provided with spaced side walls in the form of upwardly directed arcuated lugs 21 and 22. These lugs 21 and 22 are disposed in opposed relation and are provided on the ends adjacent the flange 19 with integrally formed and aligned rod support elements 23 and 24 respectively (FIGS. 1, 2 and 3). Lugs 21 and 22 are interconnected by a rod 25 the ends of which are fixed in the support elements 23 and 24 by means of set screws 26 and 27 respectively.

Intermediate lugs 21 and 22 the supporting surface 18 is provided with a bumper positioning block 28 to which a resilient bumper 29 is assembled by means of a bolt 30. In the preferred embodiment this resilient bumper 29 is termed the inner bumper and is formed from nylon or suitable rubberized fabric strap material into a coil and then bolted to the bumper block 28. It should be understood that other forms of bumpers, such as rubber block material or the like could be utilized to perform this bumper's intended function.

A picker stick braking means or so-called outer bumper 31 having a generally U-shaped configuration is in the form of a laminated strap that is fabricated from alternate layers of nylon and leather strapping or any other material suitable for its intended purpose. Adjacent each end of this outer bumper 31 there is provided an elongated guide channel or opening 32 (one only shown) and in assembled position on the support bracket the rod 25 which interconnects lugs 21 and 22, is disposed so as to extend through said slots. The sides of the outer bumpers are in frictional engagement with the opposed inner surfaces of lugs 21 and 22 which are polished to facilitate movement of said outer bumper when engaged by a picker stick. As shown in FIG. 1 the curved intermediate portion of the outer bumper 31 is in contact with a substantial portion of the outer surface of the resilient bumper 29.

To maintain the outer bumper 31 in its operating position, a cover plate 33 assembles on the support bracket so as to engage the upper surface of each lug 21 and 22 and is fixed thereto by means of cap screws 34 and 35 the threaded portions of which are assembled into tapped holes provided in the top of the bumper positioning block 28.

To summarize the operation, the loom's lay beam is continuously moving to and fro between so-called front and back centers along with the loom's parallel motion and the picker stick carried thereby. In addition to the picker stick being pivoted to and fro with the lay beam it is simultaneously caused to be pivoted in a direction substantially normal to the movement of said lay for the purpose of picking the shuttle across the width of the loom. During the picking movement of the picker stick it is caused to strike the outer surface of the outer bumper which compresses the resilient bumper 29 to allow said outer bumper to move toward the loomside a distance within the limits of the length of slots 32 through which rod 25 extends. After the picker stick strikes the outer surface of the outer bumper its movement with the lay toward the latter's back center position causes said outer bumper to yield in this direction thereby preventing the rubbing or wiping movement of the picker stick on the outer bumper. The length of the guide channels 32 in combination with the polished surfaces of lugs 21 and 22 with which the sides the outer bumper are in contact provide the freedom of movement of the latter and has increased substantially the life expectancy of both the picker sticks and bumper assemblies therefore.

Although the present invention has been described in connection with a preferred embodiment, it is to be understood that modifications and variations may be resorted to without departing from the spirit and scope of the invention as those skilled in the art will readily understand. Such modifications and variations are considered to be within the purview and scope of the invention and the appended claims.

I claim:

1. In a loom having a rock shaft, a lay beam oscillatable with the rock shaft and picker sticks for picking a shuttle back and forth across the width of the loom, a picker stick bumper assembly comprising:

a. a support bracket for attachment to the loom;

b. resilient bumper means secured to said support bracket;

c. picker stick braking means operatively associated with and for cooperative action with said resilient bumper means; and d. means mounting said picker stick braking means for floatable movement on said support bracket so that said braking means can move in directions parallel and transverse to the direction of lay beam travel.

2. The picker stick bumper assembly according to claim 1 wherein said resilient bumper means comprises a coil of resilient strap material with a substantial portion of the outer periphery thereof being in frictional contact with said picker stick braking means.

3. The picker stick bumper assembly according to claim 1 wherein said picker stick braking means comprises a laminated strap member with the ends thereof including elongated guide channels defining openings operatively associated with said mounting means.

4. The picker stick bumper assembly according to claim 3 wherein said mounting means includes a pair of spaced lug members carried by said support bracket for engagement with said strap member and a rod member extending through said guide channels and interconnecting said lug members.

* * * * *